US008814496B2

(12) United States Patent
Lehmann et al.

(10) Patent No.: US 8,814,496 B2
(45) Date of Patent: Aug. 26, 2014

(54) DEVICE FOR REDUCING THE DRIVE POWER REQUIREMENTS OF A WATERCRAFT

(71) Applicant: Becker Marine Systems GmbH & Co. KG, Hamburg (DE)

(72) Inventors: Dirk Lehmann, Winsen/Luhe (DE); Friedrich Mewis, Dresden (DE)

(73) Assignee: Becker Marine Systems GmbH & Co. KG, Hamburg (DE)

( * ) Notice: Subject to any disclaimer, the term of this patent is extended or adjusted under 35 U.S.C. 154(b) by 0 days.

(21) Appl. No.: 13/672,825

(22) Filed: Nov. 9, 2012

(65) Prior Publication Data

US 2013/0121837 A1 May 16, 2013

(30) Foreign Application Priority Data

Nov. 11, 2011 (DE) ..... 10 2011 055 304
Sep. 18, 2012 (EP) ..... 12184827

(51) Int. Cl.
*F01D 5/02* (2006.01)

(52) U.S. Cl.
USPC ..... 415/8; 415/142; 415/191; 415/208.2

(58) Field of Classification Search
USPC ..... 415/8, 9, 142, 191, 208.2
See application file for complete search history.

(56) References Cited

U.S. PATENT DOCUMENTS

| | | | | |
|---|---|---|---|---|
| 2,262,854 | A * | 11/1941 | Morris | 415/8 |
| 4,804,312 | A | 2/1989 | Schneekluth | |
| 5,580,220 | A * | 12/1996 | Baumann | 416/247 R |
| 7,267,589 | B2 * | 9/2007 | Norman | 440/67 |

FOREIGN PATENT DOCUMENTS

| | | | |
|---|---|---|---|
| DE | 3620540 | A1 | 4/1987 |
| DE | 3633689 | | 2/1988 |
| DE | 3633689 | C1 | 2/1988 |
| EP | 0470339 | A1 | 2/1992 |
| EP | 2100808 | A1 | 9/2009 |
| JP | 58-492 | A | 1/1983 |
| JP | H7-267189 | A | 10/1995 |
| JP | H9-175488 | A | 7/1997 |
| KR | 2006-0108472 | A | 10/2006 |
| KR | 2009-0097079 | A | 9/2009 |
| KR | 2012-0097939 | A | 9/2012 |

* cited by examiner

*Primary Examiner* — Ned Landrum
*Assistant Examiner* — Woody A Lee, Jr.
(74) *Attorney, Agent, or Firm* — Kelly & Kelley, LLP

(57) ABSTRACT

A device is provided for reducing the drive power requirement of a watercraft includes a fore-nozzle, wherein at least one outer fin projects outwards from the fore-nozzle.

35 Claims, 7 Drawing Sheets

DEVICE FOR REDUCING THE DRIVE POWER REQUIREMENTS OF A WATERCRAFT

Figure 1:
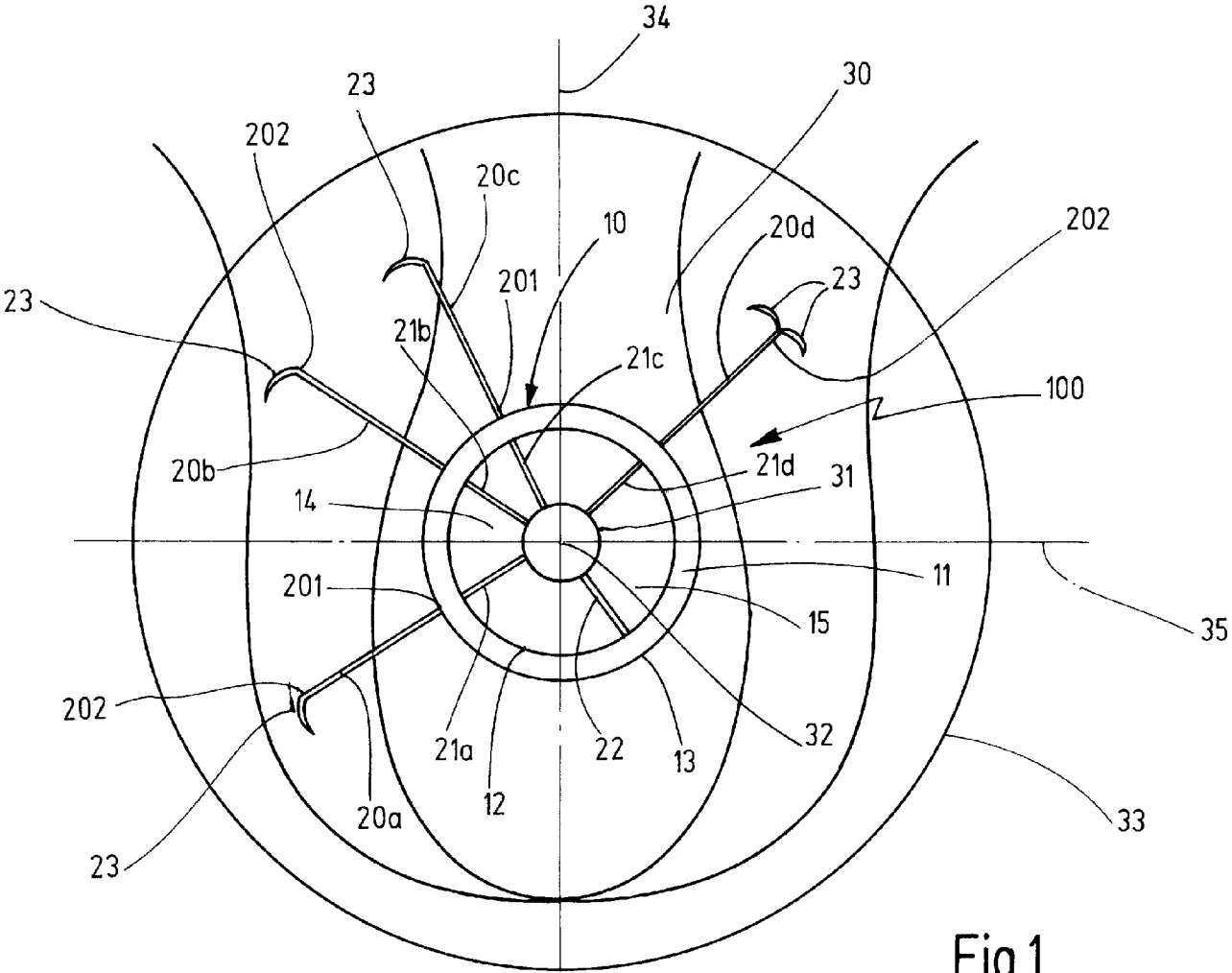

The invention relates to a device for reducing the drive power requirement of a watercraft, in particular a ship. The device according to the invention is particularly suited for improving the energy efficiency for a drive system of a watercraft.

Devices for reducing the drive power requirement of a watercraft are known from the prior art. In EP 2 100 808 A1 such a device comprises, for example, a fore-nozzle. This fore-nozzle is in particular mounted at a short distance or directly upstream of the propeller when viewed in the direction of travel of the ship. Furthermore, fins, i.e. (guide) fins or hydrofoils, are provided in the fore-nozzle. The fore-nozzle substantially has the shape of a flat cone section, where both openings, both the water inlet and the water outlet opening, are configured as a substantially circular opening and the water inlet opening has a larger diameter than the water outlet opening. As a result, it is possible to improve the propeller inflow and to reduce the losses in the propeller jet by specific generation of pre-swirl by the fins installed in the fore-nozzle. A significant reduction in the drive power requirement and therefore a saving of fuel can be achieved by such a system.

The previously known device described above, however, has a relatively large resistance for the propeller inflow so that the reduction in the drive power requirement in the relevant extent is primarily only established in slower or more heavily laden ships, so that the known device is usually only used in such ships.

It is therefore the object of the present invention to provide a device for reducing the drive power requirement of a watercraft which can also be used particularly effectively in fast and very fast watercraft, for example ships having a speed of 20 knots or more or 25 knots and more.

This object is solved whereby in a device for reducing the drive power requirement of a watercraft, comprising a fore-nozzle, at least one outer fin projecting outwards from the fore-nozzle is provided. The fore-nozzle is located upstream of a propeller of the watercraft in the direction of travel of the ship or watercraft. The designation "in the direction of travel" is to be understood here as the forwards direction of travel of a ship or a watercraft. No propeller is located inside the fore-nozzle, other than, for example, in Kort nozzles or rudder propellers. Furthermore, the fore-nozzle is located at a distance from the propeller. The fore-nozzle is configured in such a manner that water flow flowing through said fore-nozzle is at least partially guided onto the propeller located thereafter. The fore-nozzle usually has a tubular form. However, fundamentally any other type of cross-sectional shape, for example, an angular cross-sectional shape, is feasible.

The fore-nozzle can be formed in one part or in one piece or be composed of several individual parts to form a fore-nozzle, where the individual parts are preferably welded to one another or welded to the hull. Preferably at least one portion of the fore-nozzle is located underneath the propeller shaft of the ship's propeller.

It is fundamentally feasible that the fore-nozzle comprises only a subsection of a nozzle or a nozzle ring (e.g. a quarter nozzle ring, a third nozzle ring, a half nozzle ring, etc.). In such an embodiment the fore-nozzle is configured to be open when seen over the circumference. Preferably however, the fore-nozzle is configured to be closed in the circumferential direction. For this purpose the nozzle can be configured to be continuous around 360° in the circumferential direction. In a fore-nozzle configured to be multi-part, furthermore in particular with a closed nozzle circumference, the individual parts of the fore-nozzle can be connected to the hull and/or the stern tube so that the hull and/or the stern tube then form part of the nozzle circumference.

As a result of the preferably closed profile of the fore-nozzle around the circumference, this has an inner region which is enclosed by the nozzle surface area of a fore-nozzle imagined as closed at the two openings (water inlet and water outlet opening). According to the invention, the at least one outer fin is now disposed outside this inner region and rather protrudes outwards from the fore-nozzle when viewed from the fore-nozzle. In particular, the at least one outer fin can protrude from the outer side of the fore-nozzle.

In contrast to the prior art, a fin pertaining to the fore-nozzle, i.e. the at least one outer fin is now provided outside the fore-nozzle. Expediently at least one end region of the outer fin is disposed on the outer wall surface of the fore-nozzle and protrudes outwards from this. That is, the remaining region of the at least one outer fin is located at a distance from the fore-nozzle (except from the one end region of the outer fin). As a result of the arrangement of a fin on the outside of the fore-nozzle for the first time, it is now achieved that the diameter and/or the profile thickness of the fore-nozzle can be significantly reduced compared with the devices known from the prior art and nevertheless, the at least one (outer) fin still reaches those regions in which the flow losses are particularly high and in which a pre-swirl must be produced for efficient operation. If the diameter were simply to be reduced in the devices known from the prior art, in contrast to the present invention, the fins would not extend sufficiently far away from the propeller hub (in the radial direction when viewed from the propeller hub) and thus no longer or only to a lesser extent have a positive influence on the inflow onto the respectively associated propeller.

By attaching one or more outer fins to the outer side of the fore-nozzle, the diameter of the fore-nozzle and therefore its resistance can be reduced so that the device can now also be used for fast and very fast ships, where the positive effects on the reduction of the drive power requirement are preserved or possibly even further improved. Since the outer fin projects outwards from the fore-nozzle and not possibly from the propeller hub or the stern tube, this can extend relatively far outwards when viewed from the propeller axis and nevertheless still have sufficient strength, in particular in relation to bending stresses.

The at least one outer fin is a fin, i.e. a guide fin or a hydrofoil, which is located outside on the fore-nozzle. Usually the at least one outer fin is disposed fixedly on the fore-nozzle. In this context, the term "fin" can fundamentally be understood as any guide device which influences the propeller inflow, where the fins usually have a hydrofoil profile, i.e. a suction and a pressure side. Thus, the fins in the present connection are flow guiding surfaces in the sense of stators which are disposed on the fore-nozzle and influence the propeller inflow. In particular, it is preferred that the fins have an, in particular circular-arc-shaped, outwardly curved suction side and a substantially flat pressure side.

The profile of the fin can be uniform or non-uniform when observed over its length. In particular, the profile can be turned into itself, i.e. twisted, when viewed along the longitudinal direction of the fin.

The fore-nozzle can be configured to be rotationally symmetrical or rotationally asymmetrical. Furthermore, the fore-nozzle can be disposed concentrically with the propeller axis or eccentrically thereto. In particular, the axis of rotation and/or the longitudinal axis of the fore-nozzle can be disposed upwardly and/or laterally offset with respect to the propeller axis. Furthermore, the fore-nozzle can be disposed in such a manner that its axis of rotation or its longitudinal axis runs parallel to the propeller axis or runs at an angle to the propeller axis and consequently is inclined in relation to the propeller axis. The fore-nozzle is furthermore preferably aligned centrally in the horizontal direction, relative to the propeller axis. As a result, the axis of rotation of the fore-nozzle and the propeller axis lie in a vertical plane. Fundamentally however a twisted arrangement of the fore-nozzle with respect to a vertical running through the propeller axis or a parallel thereto is also possible.

The displacement of the fore-nozzle with respect to the propeller axis upwards and/or to the side can be advantageous particularly because the water speed is usually faster in the lower region of the fore-nozzle or the propeller than in the upper region as a result of the shape of the ship or the configuration of the hull. As a result of the displacement of the fore-nozzle with respect to the propeller axis, a homogenisation of the propeller inflow and therefore a better efficiency can possibly be achieved, adapted to the particular configuration of the hull.

Expediently the fore-nozzle consists of a continuous and/or one-piece annular body or nozzle ring. The fore-nozzle is disposed upstream and at a distance from the propeller in the direction of travel of the ship. The device according to the invention can advantageously be used in multi-propeller ships where a fore-nozzle is then expediently to be assigned to each propeller. The propellers assigned to the device are usually installed fixed or in a fixed position on the hull. The fore-nozzle together with the propeller of the watercraft forms a drive system.

Preferably the extension of the individual (outer) fins in the longitudinal direction of the fore-nozzle is smaller or shorter than the length of the fore-nozzle. "Extension" is to be understood in this context as the region or the length of the longitudinal profile of the fore-nozzle over which the fins extend in the longitudinal direction of the fore-nozzle. Particularly preferably the extension of the individual fins in the longitudinal direction of the fore-nozzle is less than 90%, quite particularly preferably less than 80% or even less than 60% of the length of the fore-nozzle. The longitudinal direction substantially corresponds to the direction of flow. It is furthermore preferred that the fins are disposed substantially in the rear region of the fore-nozzle, i.e. in the region facing the propeller. In principle, however, a formation of the fin over the entire extension of the fore-nozzle in the longitudinal direction or a central or front arrangement of the fins in relation to the direction of travel would also be possible.

Advantageously a first end of the at least one outer fin is fixed to the fore-nozzle. Here the first end of the outer fin can either be fixed on the outer wall surface of the fore-nozzle, for example, by flange-mounting or it can be guided into the nozzle profile, i.e. the wall of the fore-nozzle. Alternatively it is also possible to guide the outer fin through the fore-nozzle profile or the fore-nozzle wall. The first end forms the root of the at least one outer end and the second end forms the tip of the at least one outer fin.

The second end of the at least one outer fin is further expediently configured as a free end, i.e. it stands freely in the propeller inflow. In particular, only the first end of the outer fin is fastened, i.e. on the fore-nozzle and the remaining region of the outer fin is free-standing. In principle, it would be feasible to fasten the second end of the at least one outer fin, for example, on the hull. Usually, however it is sufficient and more favourable from the hydrodynamic viewpoint to guide the at least one outer fin not to the hull but only as far as is necessary for optimisation of the propeller inflow.

In a preferred embodiment, at least one inner fin is disposed inside the fore-nozzle. "Inside the fore-nozzle" is to be understood as the inner region of the fore-nozzle. The at least one inner fin is preferably located substantially, particularly preferably completely, inside the fore-nozzle, i.e. it does not project or only slightly projects from one of the two openings of the fore-nozzle. A first end of the at least one inner fin is preferably arranged on an inner wall of the fore-nozzle and expediently fastened on the fore-nozzle.

It is further preferred that the at least one inner fin is fastened with a second end on a shaft bearing, in particular a stern tube, which is configured for mounting the propeller shaft of a propeller of a watercraft. Consequently, the inner fin runs between two fixed bearing points from the shaft bearing to the fore-nozzle. Between the two ends the inner fin has a pressure side, a suction side, a nose strip and an end strip. This configuration also applies similarly for the outer fin. Depending on the configuration of the hull, the at least one inner fin can be mounted, instead of on a shaft bearing, directly on the hull or on the plating of the hull with its second end.

The configurations and shapings described hereinbefore for the outer fin can be transferred similarly to the configuration of the inner fin or can be applied there.

The fore-nozzle can preferably be connected via the at least one inner fin to the hull. Additionally or alternatively, the fore-nozzle can also be connected to the hull via further connecting means, for example "brackets" or retaining clips located for example below or above the fore-nozzle or shaft bracket arms. The shaft bracket arms could also be configured as fins, inner fin and/or outer fin, at least in certain areas. The at least one inner fin and the at least one outer fin can have the same or different lengths.

It is further expedient that the at least one outer fin and/or the at least one inner fin are arranged substantially in the radial direction to the longitudinal axis or the axis of rotation of the fore-nozzle or to the propeller axis of a drive propeller of a watercraft. Preferably both fins, outer and inner fin, are arranged in the radial direction. In cases in which the fore-nozzle is arranged coaxially to the propeller axis and is configured to be rotationally symmetrical, the longitudinal axis or the axis of rotation of the fore-nozzle will fall on the propeller axis so that the fins are then arranged radially to all three axes. If the fore-nozzle with its axis of rotation or its longitudinal axis is shifted with respect to the propeller axis, these no longer coincide and the fins are preferably arranged radially to the propeller axis. In principle, the at least one outer fin and the at least one inner fin could be arranged at different angles to their respective tangents. The tangent for the at least one outer fin runs through a point on the outer wall surface of the fore-nozzle whereas the tangent for the at least one inner fin runs through a point of the inner wall surface of the fore-nozzle.

In a preferred embodiment a plurality of outer fins and/or a plurality of inner fins are provided. In particular, it is preferred that the same number of outer fins and of inner fins is provided. In principle, however, it would also be possible to provide an unequal number of outer fins and inner fins.

It is particularly preferred that the device has at least three inner fins and/or at least three outer fins, preferably three to seven inner fins and/or three to seven outer fins. In a preferred embodiment, an odd number of outer fins and/or inner fins can be provided.

It is further preferred that more outer fins are provided on the propeller upwards-turning side of the fore-nozzle than on the propeller downwards-turning side of the fore-nozzle and/or that more inner fins are provided on the propeller upwards-turning side of the fore-nozzle than on the propeller downwards-turning side of the fore-nozzle. The term "propeller upwards-turning side of the fore-nozzle" is understood as that side of the fore-nozzle on which the propeller disposed downstream of the fore-nozzle in a frontal view of the fore-nozzle turns from bottom to top in forward motion. Accordingly on the propeller downwards-turning side the propeller turns from top to bottom. The embodiment described in the present case can therefore be used particularly expediently in fore-nozzles whose axis of rotation is not displaced laterally with respect to the propeller axis but rather lies in a plane standing vertically on the propeller axis so that with an imaginary division of the fore-nozzle by a central vertical axis one half of the fore-nozzle lies on the propeller upwards-turning side and the other half lies on the propeller downwards-turning side.

In order to minimise the rotational losses at the propeller and to reduce twisting in the propeller backwash induced by the propeller inflow perturbed by the hull of the ship, a (pre-) swirl is produced by the fins (outer fins or inner fins) disposed on the fore-nozzle which is aligned in such a manner that a smaller twisting of the flow is established downstream of the propeller in the propeller backwash region compared to a propeller without a fore-nozzle with fins placed in front. The twisting of the propeller backwash is particularly small if on the propeller upwards-turning side at least one outer fin and/or one inner fin more is disposed than on the propeller downwards-turning side.

Alternatively or additionally to the distribution of the outer fins and/or inner fins on the propeller upwards-turning side and propeller downwards-turning side, the outer fins and/or the inner fins can form an asymmetric outer fin system or an asymmetric inner fin system. Here, an asymmetry relates, for example, to an angular arrangement of the fins with respect to the propeller axis or the axis of rotation of the fore-nozzle and/or their dimensioning such as profile length, profile cross-section or another quantity. In the case of an asymmetry in relation to the angular arrangement directed onto the propeller axis or the axis of rotation of the fore-nozzle, an unequal angular distribution is established between the axes of the individual outer fins and/or inner fins when viewed in the radial direction from the propeller axis or axis of rotation of the fore-nozzle. An asymmetric arrangement can also be present if in a cross-sectional view of the fore-nozzle, the vertical central axis of the fore-nozzle is used as the axis of symmetry. The axis of symmetry usually at the same time divides the upwards-turning and downwards-turning side of the fore-nozzle. This results in a particularly effective outer fin system or inner fin system in a manner which is easy to configure and arrange.

In a further preferred embodiment, the at least one outer fin is arranged in an extension of the at least one inner fin so that both together form a complete fin. Thus, for example, the longitudinal axes of the outer fin and the inner fin can substantially stand on one another and/or the outer fin and the inner fin are disposed on a common radial axis. Preferably the first end of the inner fin, which is expediently disposed on the inner wall surface of the fore-nozzle is located opposite the first end of the outer fin which is disposed on the outer wall surface so that only the fore-nozzle wall lies between the two fins. In principle, both end regions could each be introduced into the profile or the nozzle wall so that these then possibly abut against one another or are only slightly spaced apart from one another. It is also possible to use a continuous fin which is guided through a recess in the fore-nozzle and of which one subsection forms an outer fin and another subsection forms an inner fin. As a result of this preferred arrangement of the two fins, fluidically a single fin is obtained which expediently runs from the shaft bearing to the free end of the outer fin. If a plurality of outer fins and inner fins, in particular the same number of outer fins and inner fins are provided, these are each advantageously arranged in fin pairs which then each form complete fins. Thus, for example, three outer fins and three inner fins could together form three complete fins.

Compared to the pure stator arrangements known from the prior art or arrangements with fins without nozzle or nozzle elements, projecting radially from the stern tube, a significantly increased strength of the entire arrangement is obtained through the provision of the fore-nozzle. As a result, the complete fins can be designed to be sufficiently long with an ensured fatigue strength in order to optimally influence the inflow onto the propeller or achieve the best possible efficiency. In the aforementioned known arrangements with long fins without nozzle ring, a fatigue strength is frequently not achieved.

The length of the complete fins can fundamentally be larger or smaller than the radius of a propeller of the watercraft assigned to the fore-nozzle. The length of the complete fin is measured from the propeller axis to the outermost (free) end of the outer fin, where optionally the nozzle wall disposed between the two fins (outer and inner fin) is also included. Preferably the length of the complete fin is a maximum of 90% of the radius of the propeller, particularly preferably a maximum of only 75%. A sufficient strength of the device is thereby achieved.

In a further preferred embodiment, the at least one outer fin and/or the at least one inner fin are disposed at an angle of attack radially to the propeller axis and/or to the longitudinal axis of the fore-nozzle. In particular, the at least one outer fin and the at least one inner fin can have different angles of attack. If a plurality of outer fins and/or inner fins are provided, these can also have different angles of attack amongst one another. By setting the different angles of attack, it is possible to optimise the pre-swirl. The angle of adjustment is, for example, enclosed by a chord running from the nose strip to the end strip of the respective fin or also the longitudinal axis of the fin in cross-sectional view and the propeller axis or the longitudinal axis of the fore-nozzle.

In a further preferred embodiment the at least one outer fin has a free end which forms the region of the outer fin most remote from the fore-nozzle. At this free end region a fin end piece protrudes from the outer fin. Thus, for example, a longitudinal axis of this fin end piece can be located at an angle to the longitudinal axis of the outer fin. The term "protruding fin end piece" in the present case fundamentally means all the components disposed in the region of the free end of the outer fin which are not disposed precisely in the extension of the outer fin but protrude obliquely from the outer fin or at a specific angle from the outer fin or deviate from the fictitiously extended profile contour of the outer fin. The fin end piece therefore protrudes from the fin plane. Such a protruding fin end piece acts similar to the "winglets" known from aircraft aerofoils and reduces the probability of vortices becoming detached in the end region of the outer fin and of cavitation occurring in the same.

The fin end piece can transform into the free end region of the outer fin at a radius. Alternatively the fin end piece can be mounted at an angle on the free end of the outer fin so that the fin end piece plane and outer fin plane are at this angle.

In principle, the fin end piece on both sides, i.e. both on the pressure side and on the suction side, of the outer fin, can protrude from this or only on one of the two sides. In the last embodiment it is preferred that the fin end pieces only protrude towards the suction side of the outer fin since as a result the greater hydrodynamic effects in relation to the reduction of vortex formation can be achieved. For the embodiment in which the fin end piece protrudes or projects on both sides of the outer fin, two separate fin end pieces can also be provided which then each protrude on one side. In principle, however, in this embodiment a one-piece design of the fin end piece is possible.

It is further preferred that in the presence of at least one outer fin and at least one inner fin, the outer fin has a larger length than the inner fin. In particular, the length of the outer fin can be at least one and a half times, preferably at least twice as large as the length of the inner fin. As a result of this embodiment, an improved effect in relation to the drive power requirements and in relation to the stability of the device is achieved. As a result of the length distribution in this preferred embodiment, the fore-nozzle or the nozzle ring is disposed relatively close to the shaft bearing of the propeller shaft so that the device has a relatively low resistance and can also be used for very fast ships. Fundamentally, however, a design is possible in which the at least one inner fin has a greater length than the at least one outer fin, e.g. at least one and a half times or at least twice the length, or in which both have approximately the same length.

Similarly it is advantageous if the diameter of the fore-nozzle is no more than 85%, preferably no more than 70%, particularly preferably no more than 50% or no more than 35% of that diameter of the (ship's) propeller to which the fore-nozzle is assigned. This also ensures that the nozzle profile or the nozzle ring overall is not too large and therefore the resistance of the fore-nozzle is so low that it is possible to also use the device in fast and very fast ships. If the fore-nozzle should not be rotationally symmetrical or cylindrical or conical, instead of the diameter, the greatest extension of the fore-nozzle in height or width can be related to the propeller diameter. Furthermore, the outside diameter of the fore-nozzle should expediently be used.

In order to ensure a sufficiently low resistance of the device, according to a further embodiment it can be provided that the profile thickness of the fore-nozzle is no more than 10%, preferably no more than 7.5%, particularly preferably no more than 6% of the length of the fore-nozzle. Here the maximum profile thickness and the maximum extension in the longitudinal direction, i.e. from one opening of the fore-nozzle to another, should be used. Through this, the resistance of the device is also reduced further.

In a further preferred embodiment, a stabilizing strut is further provided which is disposed between shaft bearing and inner side of the fore-nozzle and is fastened both on the shaft bearing and on the fore-nozzle. Such a stabilizing strut can be provided if according to local conditions or particular configuration of the device, an additional stabilization or retaining of the device or the fore-nozzle is desired. Outside the fore-nozzle in extension of the stabilizing strut usually no further strut or even an outer fin is to be provided. The strut can fundamentally be configured as a normal compression or tension rod without flow-guiding properties. Alternatively, the stabilizing strut itself can also have a fin profile, i.e. a hydrofoil profile or similar for specific influencing of the propeller inflow, for example, to produce pre-swirl.

The at least one outer fin and/or the at least one inner fin can be configured as sweptback fins. The term "sweptback", known, inter alia, from air travel, is to be understood in the present context as an angular deviation of the outer fin and/or the inner fin in relation to an orthogonal of the longitudinal axis of the fore-nozzle. In this case, the leading edge and/or trailing edge of the fin (inner fin and/or outer fin), when viewed in the through-flow direction, can be inclined at an angle with respect to the orthogonal (these states are known as leading-edge sweep or trailing-edge sweep). In one embodiment only the leading edge of the outer fin and/or the inner fin is inclined with respect to the orthogonal or located at an angle to the orthogonal and the trailing edge is aligned approximately parallel to the orthogonal. There can also be embodiments in which only the at least one outer fin is configured as a sweptback fin but not the at least inner fin. In another embodiment, both the at least one outer fin and the at least one inner fin are configured as sweptback fins. This can in particular be preferred when the fore-nozzle comprises at least one complete fin where the complete fin is then particularly preferably configured as a continuously sweptback fin, i.e. with the same angular deviations of the leading edges and/or the trailing edges of the at least one outer fin and the at least one inner fin to the orthogonal of the longitudinal axis of the fore-nozzle.

Figure 2:
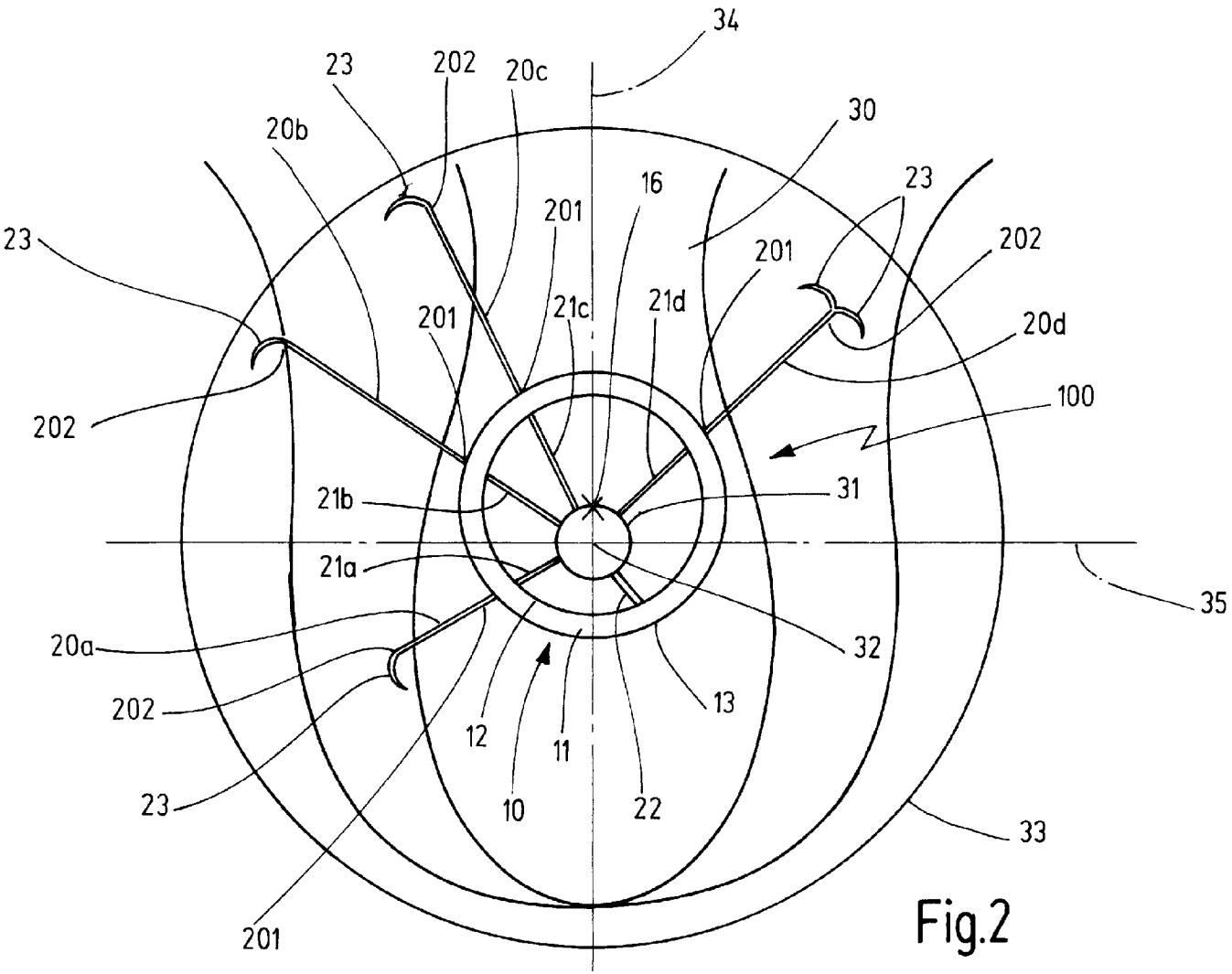
Figure 3:
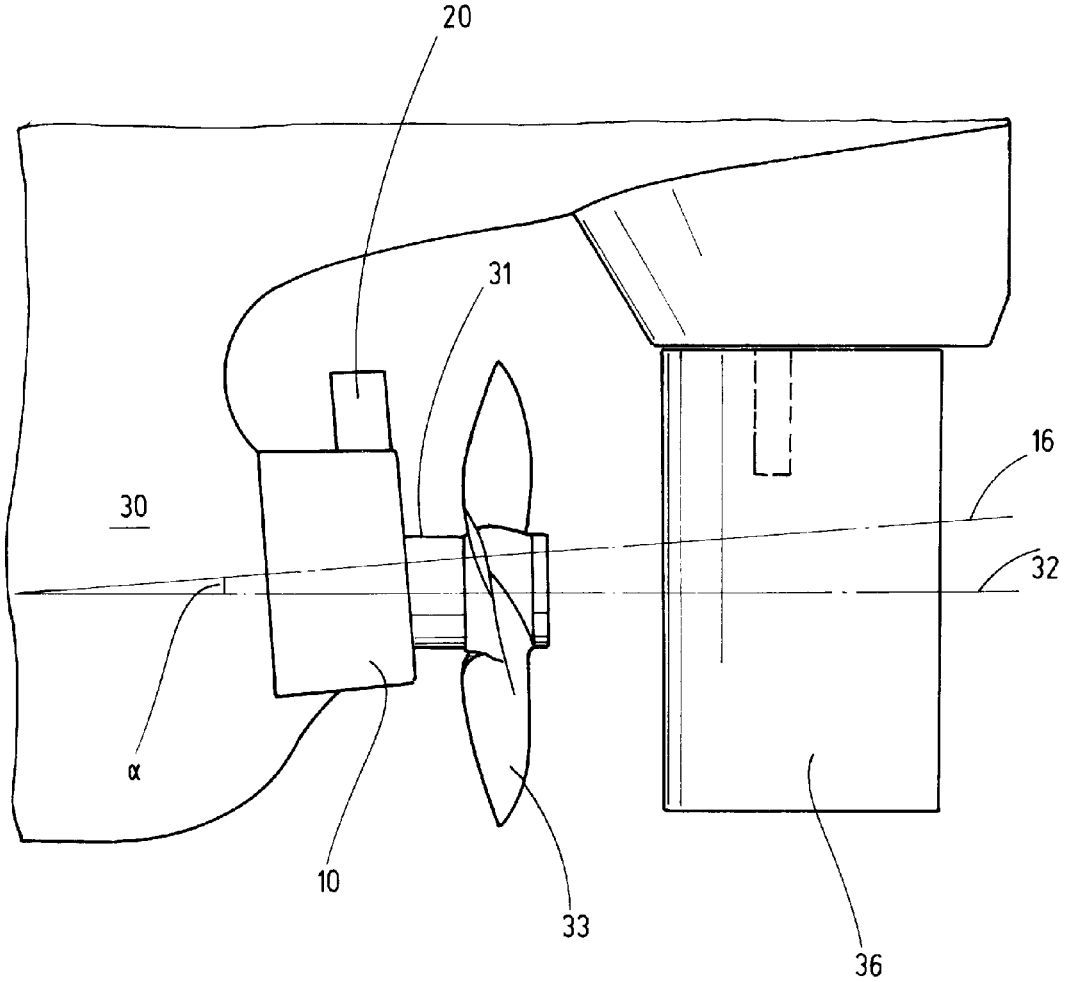
Figure 4:
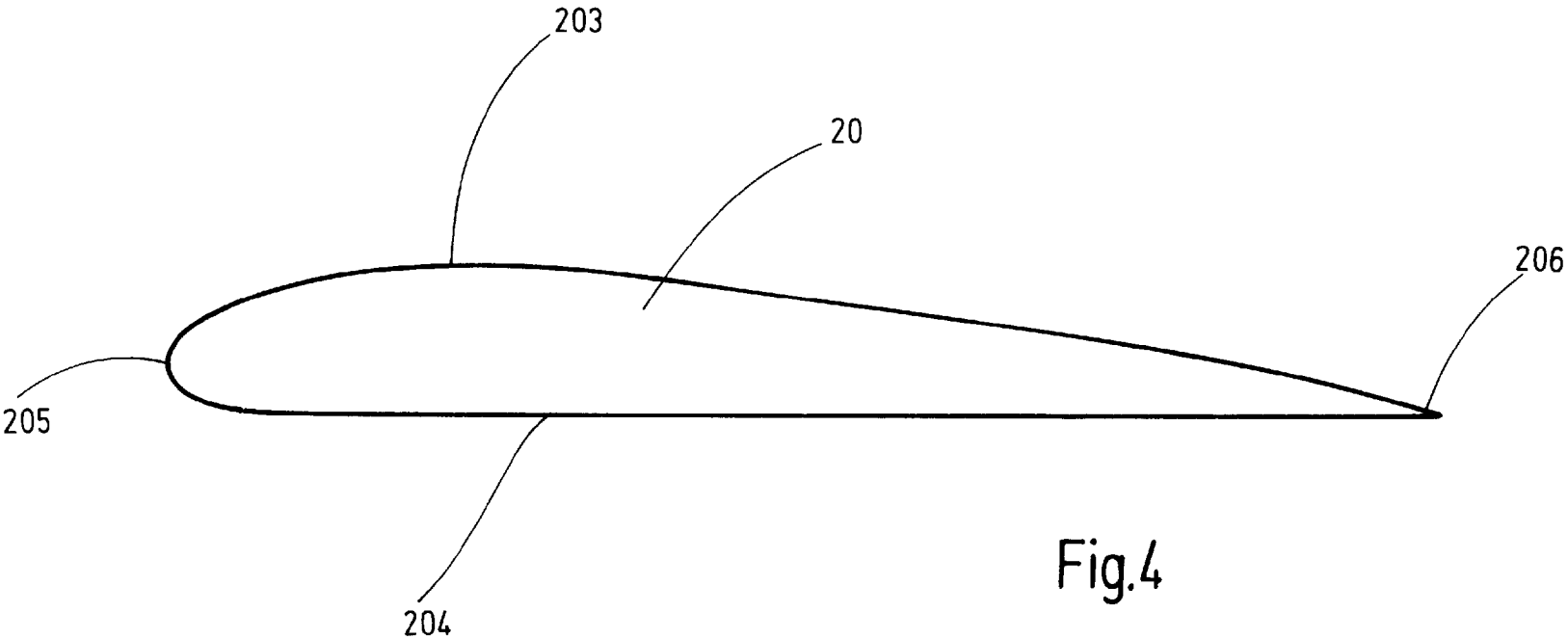
Figure 5:
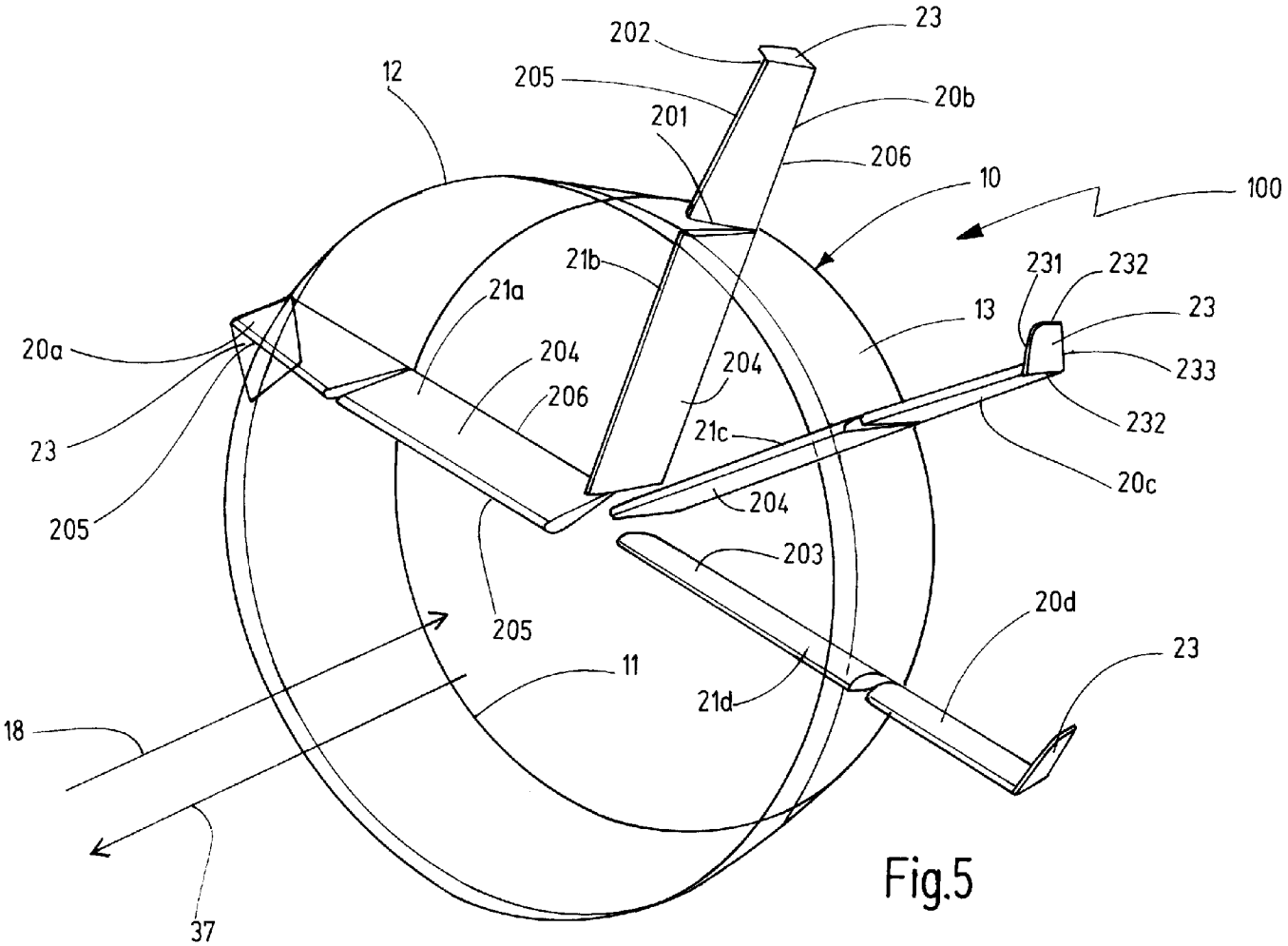
Figure 6:
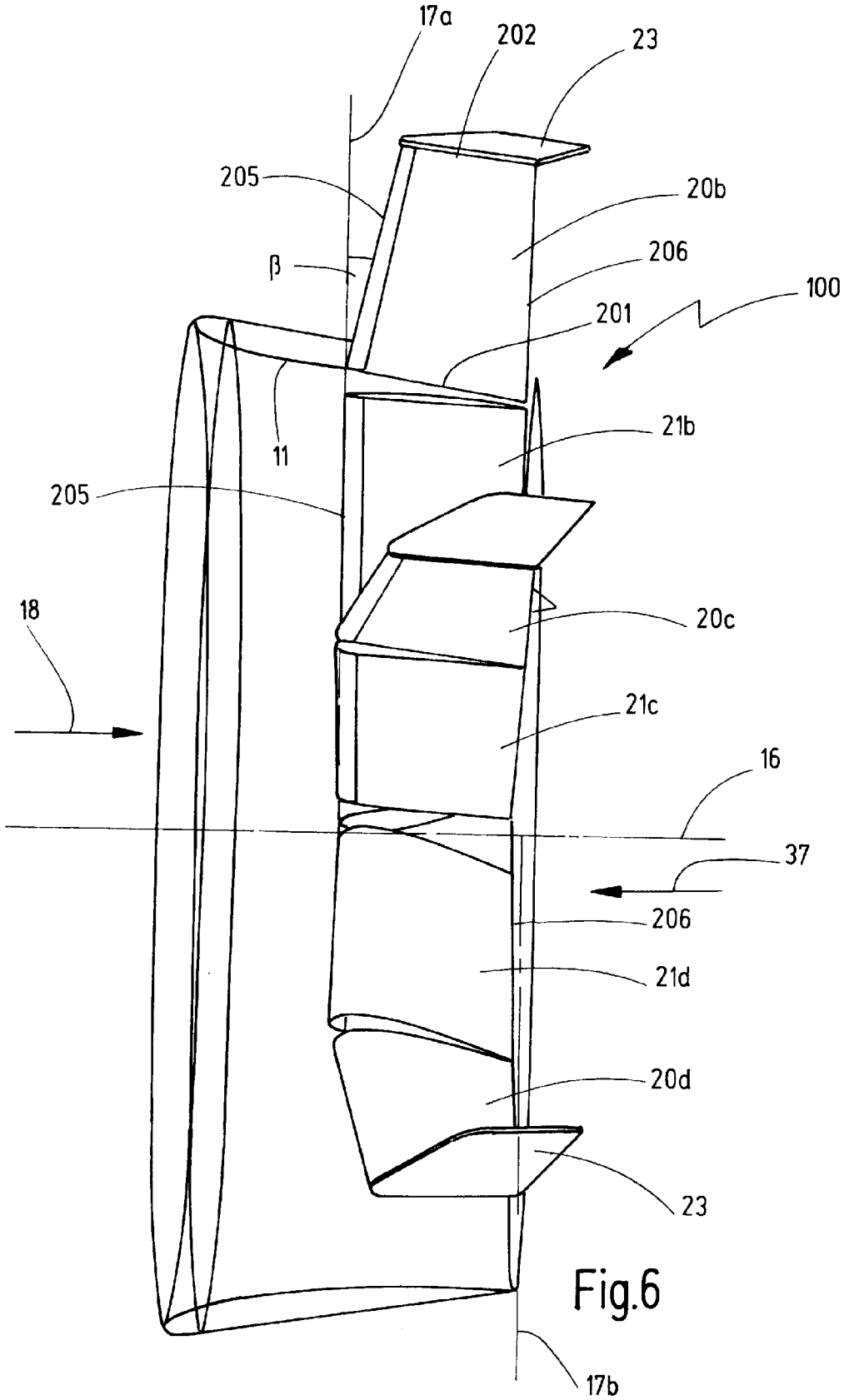

The invention is explained in further detail hereinafter by means of the exemplary embodiments shown in the drawings. In the figures shown schematically:

FIG. 1: shows a rear view of a lower region of a hull with fore-nozzle arranged coaxially with the propeller;

FIG. 2: shows a rear view of a lower part of a hull with fore-nozzle shifted upwards with respect to the propeller axis;

FIG. 3: shows a side view of a fore-nozzle with outer fin which is inclined with respect to the propeller axis;

FIG. 4: shows a sectional view of a fin;

FIG. 5: shows a perspective view of a further embodiment of the device;

FIG. 6: shows a side view of the device from FIG. 5; and

Figure 7:
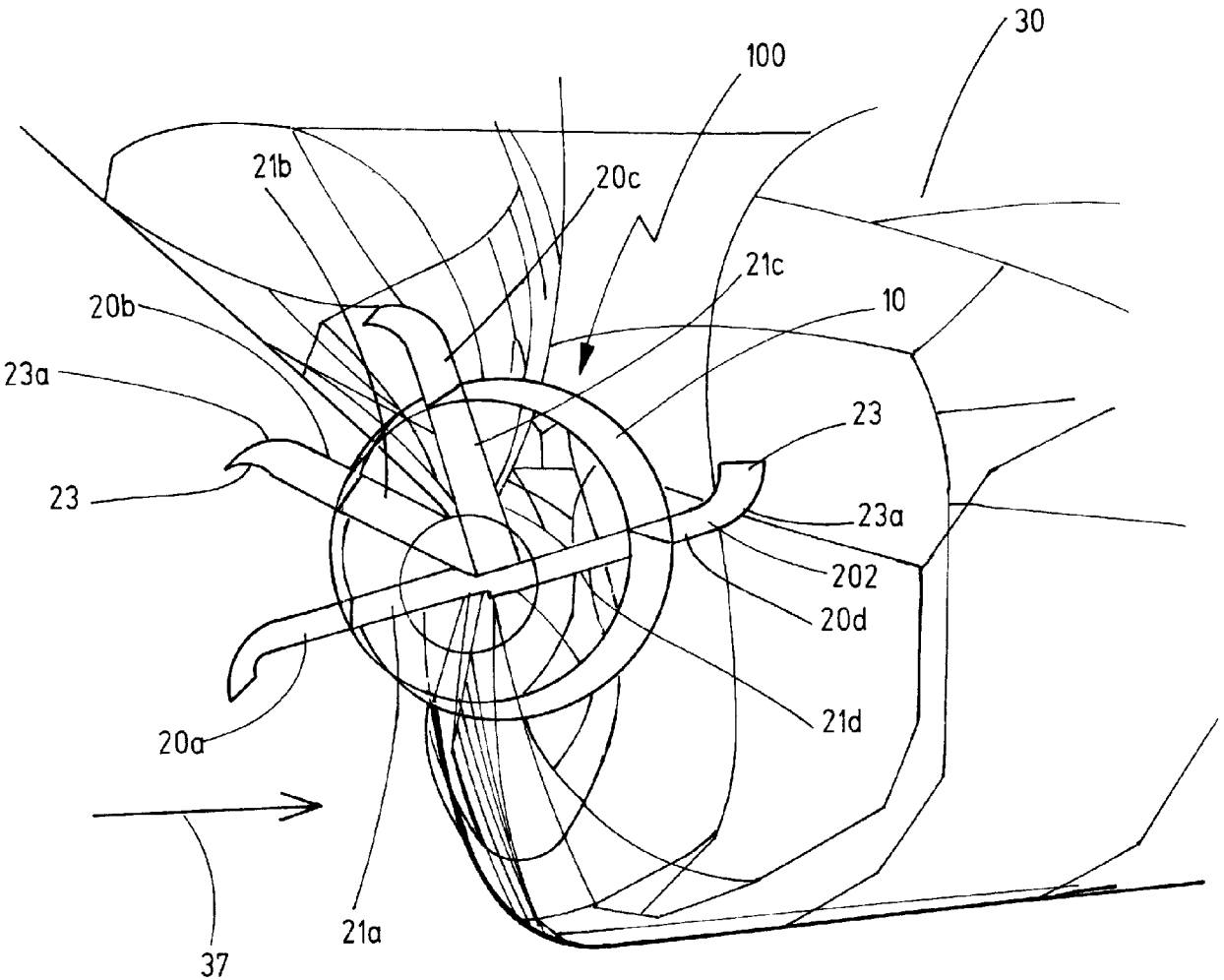

FIG. 7: shows a perspective view of a further embodiment of the device installed on a hull.

In the various embodiments shown in the following, the same components are provided with the same reference numbers.

FIG. 1 shows a rear view of the rear lower region of a hull 30. A shaft bearing 31 configured as a stern tube projects from the hull 30 from the stern approximately in the horizontal direction. In the diagram in FIG. 1, the shaft bearing 31 runs out from the plane of the drawing or into this. A propeller shaft (not shown here) which runs along the propeller axis 32, is mounted in the shaft bearing 31. In the diagram from FIG. 1 the propeller axis 32 also leads out from the plane of the drawing or into this. The propeller axis 32 at the same time forms the longitudinal axis of a fore-nozzle 10 arranged concentrically about the propeller axis 32. Since the fore-nozzle 10 in the present exemplary embodiment is shown as a rotationally symmetrical body, the propeller axis 32 at the same time also forms the axis of rotation of the fore-nozzle 10. The propeller 33 is only indicated schematically as a propeller circle since this lies downstream of the fore-nozzle 10 in the direction of travel and therefore outside the plane of the drawing. The present ship is a so-called single-propeller ship and therefore only has one propeller 33.

The fore-nozzle 10 has a circumferentially closed fore-nozzle wall 11 which in turn comprises an inner wall surface 12 and an outer fore-nozzle wall surface 13. A vertical central line 34 and a horizontal central line 35 is drawn through the propeller 33. Since the fore-nozzle 10 is arranged concentrically to the propeller 33, the central lines 34, 35 are also central lines for the fore-nozzle 10. The propeller axis 32 lies at the point of intersection of the two central lines 34, 35. In an imaginary division of the fore-nozzle 10 by the vertical central line 34, the left fore-nozzle half is the propeller upwards-turning side 14 of the fore-nozzle 10 and the right fore-nozzle half is the propeller downwards-turning side 15 of the fore-nozzle 10.

Inner fins 21*a*, 21*b*, 21*c* each disposed to run between the shaft bearing 31 and the inner side 12 of the fore-nozzle wall 11 are provided on the propeller upwards-turning side 14 of the fore-nozzle 10 (in relation to a clockwise propeller). Another inner fin 21*d* which also runs between shaft bearing 31 and fore-nozzle wall 11 is mounted on the propeller downwards-turning side 15 and specifically above the horizontal central line 35. The inner fins 21*a*, 21*b*, 21*c*, 21*d* are each fastened on the shaft bearing 31 and on the fore-nozzle 10. From the outer fore-nozzle wall surface 13, four outer fins 20*a*, 20*b*, 20*c*, 20*d* project outwards from the fore-nozzle 10. The outer fins 20*a*, 20*b*, 20*c*, 20*d* are each arranged in extension of the inner fins 21*a*, 21*b*, 21*c*, 21*d*. The outer fins 20*a*, 20*b*, 20*c*, 20*d* and also the inner fins 21*a*, 21*b*, 21*c*, 21*d* are all arranged radially to the propeller axis 32 or the axis of rotation of the fore-nozzle and run accordingly in the radial direction to the propeller axis 32. The longitudinal axis of the inner fins 21*a*, 21*b*, 21*c*, 21*d* approximately corresponds to the longitudinal axis of the outer fins 20*a*, 20*b*, 20*c*, 20*d* in an imaginary extension. Therefore the individual fin pairs 20*a*, 21*a*; 20*b*, 21*b*; 20*c*, 21*c*; 20*d*, 21*d*; each form a complete fin. That is, they act fluidically approximately as a continuous fin but are de facto interrupted by the fore-nozzle 10 and each fastened thereon (for example, by welding or by welding to the fore-nozzle). The device 100 thereby acquires a high stability with a relatively large length of the complete fin.

Overall three complete fins are arranged on the propeller upwards-turning side 14 and one complete fin on the propeller downwards-turning side 15. On the propeller downwards-turning side 15 and specifically below the horizontal central line 35, there is further provided a stabilizing strut 22 which runs between shaft bearing 31 and fore-nozzle 10 and is connected to both. This stabilizing strut 22 is configured in such a manner that it acts as a compression or tension rod and fastens the fore-nozzle 10 to the hull and stabilizes this. The stabilizing strut 22 is not configured as a fin, i.e. it does not have a hydrofoil profile or the like but is configured in such a manner that it influences the flow as little as possible. The stabilizing strut 22 has a greater profile width compared with the fins 20*a*, 20*b*, 20*c*, 20*d*, 21*a*, 21*b*, 21*c*, 21*d*.

The outer fins 20*a*, 20*b*, 20*c*, 20*d* each have a first end 201 which is disposed on the outer wall surface 13 of the fore-nozzle 10 and is connected to the fore-nozzle 10. The outer fins also have a second end 202 opposite the first end 201 which is configured as a free end. Fin end pieces 23 project laterally from the second end 202. In the diagram in FIG. 1, the fin end pieces 23 each point towards the lower side of the outer fins 20*a*, 20*b*, 20*c*, which forms the suction side. At the outer fin 20*d*, two fin end pieces 23 which are arranged symmetrically to one another are provided on the free end 202. One fin end piece 23 protrudes towards the upper side and one towards the lower side of the outer fin 20*d*. The fin end pieces 23 act as "winglets" and reduce the occurrence of so-called detachment turbulence and cavitation in the region of the free ends 202 of the outer fins 20*a*, 20*b*, 20*c*, 20*d*. The fin end pieces 23 each transform into the respective outer fin 20*a*, 20*b*, 20*c*, 20*d* at a radius.

FIG. 2 shows a similar view to FIG. 1. In the embodiment according to FIG. 2, unlike FIG. 1, the fore-nozzle 10 with its axis of rotation 16, which at the same time also forms the longitudinal axis of the fore-nozzle 10, is shifted upwards with respect to the propeller axis 32. Accordingly, the inner fins 21*a*, 21*b*, 21*c*, 21*d* have different lengths whereas in the diagram from FIG. 1 the inner fins 21*a*, 21*b*, 21*c*, 21*d* all have the same length. The stabilizing strut 22 is also shortened compared with the embodiment from FIG. 1. In the diagram from FIG. 2, the outer fins 20*a*, 20*b*, 20*c*, 20*d* furthermore also have different lengths whereas in the diagram from FIG. 1 the outer fins 20*a*, 20*b*, 20*c*, 20*d* each have the same length. Both in the embodiment from FIG. 1 and in the embodiment from FIG. 2, the radius of the propeller 33 is in each case greater than the length of the (longest) complete fin. In the embodiment from FIG. 2 the length of the longest complete fin (for example, composed of outer fin 20*c* and inner fin 21*c*) is longer than the complete fin from FIG. 1.

FIG. 3 shows a side view of the lower stern section of a ship. A shaft bearing 31, configured as a stern tube in which a propeller shaft (not shown here) is disposed, projects approximately horizontally from the stern of a hull 30. The propeller shaft runs along a propeller axis 32. A propeller 33 is provided at the end of the shaft bearing 31. A fore-nozzle 10 is further provided in the direction of travel ahead of the propeller 33. The axis of rotation or longitudinal axis 16 runs centrally through the rotationally symmetrical fore-nozzle 10. The fore-nozzle 10 is shifted upwards with its axis of rotation 16 with respect to the propeller axis 32. Furthermore, the axis of rotation 16 is inclined at an angle $\alpha$ with respect to the propeller axis 32. That is, the fore-nozzle 10 is aligned or disposed with its leading upper edge region when viewed in the direction of travel inclined or tilted downwards with respect to the propeller axis 32. In the upper region of the fore-nozzle 10, an outer fin 20 projects upwards from the fore-nozzle 10. The outer fin 20 is located in the rear region of the fore-nozzle 10 facing the propeller 33 when viewed in the direction of travel. A rudder 36 for maneuvering the ship is provided downstream of the propeller 33 in the direction of travel.

FIG. 4 shows a cross-sectional view of an example of a fin. The fin shown can in principle be the cross-section of an outer fins 20*a*, 20*b*, 20*c*, 20*d* or an inner fins 21*a*, 21*b*, 21*c*, 21*d*. In the example shown in FIG. 4 the fin shown is an outer fin 20. The fin 20 has a curved suction side 203 located at the top in the drawing of FIG. 4 and a substantially flat pressure side 204 located opposite. The rounded front face 205 which forms a part of the leading edge of the fin 20 would be placed in the flow, i.e. disposed upstream in a built-in state in the fore-nozzle. To that effect, the rearward face 206 which approximately tapers to a point (i.e. the profile end), which forms a part of the trailing edge of the fin 20, would be disposed downstream of the propeller in the built-in state in the fore-nozzle 10.

FIG. 5 shows a perspective view of another embodiment of the device 100 according to the invention. This device 100 also comprises a nozzle ring closed into itself in the circumferential direction or a fore-nozzle 10 and four outer fins 20*a* to 20*d* and four inner fins 21*a* to 21*d*, where respectively one pair of fins 20*a*, 21*a*; 20*b*, 21*b*; 20*c*, 21*c*; 20*d*, 21*d* forms a complete fin. The individual fins 20*a* to 20*d*; 21*a* to 21*d* each have a cross-sectional profile in the manner as shown in FIG. 4. In particular, each of the fins 20*a* to 20*d*; 21*a* to 21*d* comprises a suction side 203 and a pressure side 204. The fins 20*a* to 20*d*; 21*a* to 21*d* are each disposed in the rear region of the fore-nozzle 10. The diagram in FIG. 5 shows a type of exploded view so that the individual fins 20*a* to 20*d*; 21*a* to 21*d* are not shown continuously in their state connected to the fore-nozzle 10. Both the outer fins 20*a* to 20*d* and the inner fins 21*a* to 21*d* are disposed in the rear region of the fore-nozzle 10 when viewed in the direction of travel 37. In particular, the rear region is no longer than 70%, preferably 55%, of the total length of the fore-nozzle 10 when viewed in the direction of travel. The fore-nozzle 10 is shown transparent in FIG. 5 so that for reasons of clarity the outer fins 20*a* to 20*d* and the inner fins 21*a* to 21*d* are each completely identifiable.

The fin end pieces 23 which are attached to each of the second ends 202 of the outer fins 20*a* to 20*d* are configured in the manner of plates and project laterally on one side from the outer fins 20*a* to 20*d*. The edge 231 of the fin end pieces 23 configured as plates, facing the leading edge or the front face 205 of the outer fins 20*a*-20*d* runs laterally to the main inflow direction 18 of the fore-nozzle 10 and slightly obliquely rearwards. The two lateral edges 232 of the fin end pieces 23 are aligned approximately parallel to the main inflow direction 18 whilst the trailing edge 233 of the fin end pieces 23 runs substantially orthogonally to the main inflow direction 18. In relation to the longitudinal direction of the outer fins 20*a* to 20*d*, the fin end pieces 23 protrude outwards at an angle of 90° to 120° where the fin end pieces 23 in the case of a clockwise propeller protrude laterally from the outer fins 20*a* to 20*d* in the direction of rotation of the propeller. In the device 100 from FIG. 5, the inner fins 21*a* to 21*d* each have a greater length than the outer fins 20*a* to 20*d*. Furthermore all the outer fins 20*a* to 20*d* have the same dimensions in relation to their length, width and depth, and also profile shape. The same applies similarly for the inner fins 21*a* to 21*d*. Since the inner fins 21*a* to 21*d* have the same length, the axis of rotation or longitudinal axis of the fore-nozzle 10 is arranged coaxially with the propeller axis, that is the two axes lies one upon the other.

The outer fins 20*a* to 20*d* are configured as sweptback fins whereas the inner fins 21*a* to 21*d* are not. This can be seen in detail in the diagram in FIG. 6 which shows the device 100 from FIG. 5 in a side view. The axis of rotation or longitudinal axis 16 of the fore-nozzle 10 is indicated in the diagram in FIG. 6. A first upwardly-projecting orthogonal 17*a* and a second downwardly-projecting orthogonal 17*b* to the axis of rotation 16 is indicated. The fore-nozzle 10 is shown transparent in FIG. 6 so that for reasons of clarity the interior inner fins 21*b* to 21*d* can be identified. It can further be identified that the leading edge 205 of the inner fin 21*b* is disposed substantially parallel to the orthogonal 17*a*. It can also be identified that the trailing edge 206 of the inner fin 21*d* is disposed substantially parallel to the orthogonal 17*b*. Since the inner fins 21*b* to 21*d* have the same configuration, these parallel arrangements apply similarly for all inner fins 21*b* to 21*d*. In other words, the depth of the inner fins 21*b* to 21*d* when viewed in the main inflow direction 18 or when viewed in the direction of travel 37 is substantially constant over the length of the inner fins 21*b* to 21*d*. The inner fins 21*b* to 21*d* are accordingly not configured as sweptback fins.

In contrast to this, the outer fins 20*b* to 20*d* are configured as sweptback fins and specifically having a leading-edge sweep. Accordingly, the leading edge 205 of the outer fin 20*b* is aligned at a sweep angle β to the orthogonal 17*a*. This applies similarly for the remaining outer fins as a result of the same configuration. The trailing edges 206 of the outer fins 20*b* to 20*d* are again aligned substantially parallel to the orthogonals 17*a*, 17*b* so that the trailing edge of the outer fins 20*b* to 20*d* is not swept, that is, not inclined at an angle to the orthogonals. Accordingly the depth of the outer fins 20*b* to 20*d* decreases when viewed in the direction of travel 37 from the first end 201 to the second end 202. Since the leading edge 205 is rectilinear, the decrease from one end 201 to the other end 202 is continuous. The outer fin 20*a* and inner fin 21*a* not shown in FIG. 6 are configured similarly to the other inner fins 21*b* to 21*d* and outer fins 20*b* to 20*d*.

It can be further identified in FIG. 6 that the outside diameter of the fore-nozzle 10 decreases continuously in the main inflow direction 18. Likewise, the inside diameter of the fore-nozzle 10 decreases in the main inflow direction 18 but not continuously as a result of the arcuate configuration of the inner fore-nozzle wall surface 11 in profile view.

FIG. 7 shows another embodiment of a device 100 according to the invention which is configured similarly to that from FIGS. 5 and 6. In particular this device 100 also comprises four outer fins 20*a* to 20*d* and four inner fins 21*a* to 21*d* where respectively one fin pair forms a complete fin. Both in the embodiment from FIG. 7 and also in the embodiment from FIGS. 5 and 6, and 1 and 2, the complete fins are arranged asymmetrically inside the fore-nozzle 10.

In contrast to the embodiment according to FIGS. 5 and 6, in the embodiment from FIG. 7 the second end 202 of the outer fins 20*a* to 20*d* does not go over into the fin end pieces 23 at an angle, but with a transition 23*a* having a radius. Furthermore, in FIG. 7 the complete fins run through the fore-nozzles 10, that is, the complete fins are formed in one piece whereas in the embodiment from FIGS. 5 and 6 the complete fins are each formed in two pieces and the inner fins and outer fins are each fastened separately to the fore-nozzle 10. Another difference in the embodiment according to FIG. 7 with respect to the embodiment according to FIGS. 5 and 6 consists in that both the inner fins 21*a* to 21*d* and also the outer fins 20*a* to 20*d* are configured as sweptback fins. Here also only the leading edge of the fin is configured swept in each case, but not the trailing edge. The sweep of the leading edges of the inner fins 21*a* to 21*d* is accomplished at the same angle with respect to an orthogonal to the axis of rotation as for the outer fins 20*a* to 20*d* so that a continuous leading-edge sweep with a constant angle is obtained.

It can further be identified in FIG. 7 that the device 100 is mounted on the hull 30 and specifically in the direction of travel 37 at the rear end of the hull 30.

The invention claimed is:

1. A device for reducing the drive power requirement of a watercraft comprising a fore-nozzle, wherein at least one outer fin projects outwards from the fore-nozzle, said outer fin comprising a first end and a second end, wherein said first end of said outer fin is fastened to the fore-nozzle in such a way that the first end of the outer fin is fastened to the outer wall surface of the fore-nozzle or that the first end of the outer fin rests inside the wall of the fore-nozzle, wherein said second end of the outer fin is configured as a free end, wherein only the first end of the outer fin is fastened and the remaining region of the outer fin is free-standing and wherein the outer fin is not fastened to a propeller hub.

2. The device according to claim 1, wherein at least one inner fin is disposed inside the fore-nozzle, wherein a first end of the inner fin is disposed on an inner wall surface of the fore-nozzle and particularly is fastened to the fore-nozzle.

3. The device according to claim 2, wherein the at least one inner fin is fastened with a second end to a shaft bearing which is configured for mounting of a propeller shaft of a propeller of the watercraft.

4. The device according to any one of claim 1, 2 or 3, wherein the at least one outer fin and/or the at least one inner fin are disposed radially to the longitudinal axis or axis of rotation of the fore-nozzle or radially to the propeller axis of a propeller of the watercraft.

5. The device according to claim 4, wherein the at least one outer fin or the at least one inner fin are arranged at an angle of attack with regard to the propeller axis or with regard to the longitudinal axis of the fore-nozzle, wherein the at least one outer fin and the at least one inner fin have different angles of attack.

6. The device according to any one of claims 1-3, wherein a plurality of outer fins are provided, wherein on the propeller upwards-turning side of the fore-nozzle more outer fins are provided than on the propeller downwards-turning side of the fore-nozzle, and/or that the outer fins are arranged in such a manner that they form an asymmetric outer fin system.

7. The device according to claim 2, wherein a plurality of inner fins are provided, wherein on the propeller upwards-turning side of the fore-nozzle more inner fins are provided than on the propeller downwards-turning side of the fore-nozzle and/or that the inner fins are arranged in such a manner that they form an asymmetric inner fin system.

8. The device according to claim 2, wherein the at least one outer fin is disposed in extension of the at least one inner fin and both together form a complete fin.

9. The device according to claim 8, wherein the length of the complete fin is a maximum of 90% of the radius of the propeller.

10. The device according to any one of claim 1-3 or 7-9, wherein the at least one outer fin has a free end on which a fin end piece protruding from the outer fin is provided.

11. The device according to claim 10, wherein the fin end piece transforms into the free end of the outer fin at a radius or at an angle.

12. The device according to claim 10, wherein the fin end piece protrudes only on one side or on both sides of the outer fin from the outer fin, wherein in the case of a one-sided design the fin end piece protrudes on the suction side of the at least one outer fin.

13. The device according to any one of claim 2, 3 or 7-9, wherein the at least one outer fin has a greater length than the at least one inner fin.

14. The device according to claim 13, wherein the length of the at least one outer fin is at least one and a half times as great as the length of the at least one inner fin.

15. The device according to claim 14, wherein the length of the at least one outer fin is at least twice as great as the length of the at least one inner fin.

16. The device according to any one of claim 1-3 or 7-9, wherein the diameter of the fore-nozzle is less than 70%, of the diameter of a propeller of the watercraft.

17. The device according to claim 16, wherein the diameter of the fore-nozzle is less than 50% of the diameter of the propeller of the watercraft.

18. The device according to claim 17, wherein the diameter of the fore-nozzle is less than 35% of the diameter of the propeller of the watercraft.

19. The device according to any one of claim 1-3 or 7-9, wherein the greatest profile thickness of the fore-nozzle is less than 10% of the length of the fore-nozzle.

20. The device according to claim 19, wherein the greatest profile thickness of the fore-nozzle is less than 7.5% of the length of the fore-nozzle.

21. The device according to claim 20, wherein the greatest profile thickness of the fore-nozzle is less than 6% of the length of the fore-nozzle.

22. The device according to any one of claim 1-3 or 7-9, wherein inside the fore-nozzle at least one stabilizing strut is provided for stabilizing the fore-nozzle, wherein the stabilizing strut is fastened with one end on the fore-nozzle and with another end on a stern tube which is configured for mounting a propeller shaft of a propeller of the watercraft, wherein the stabilizing strut can be configured with or without a fin profile.

23. The device according to claim 9, wherein the length of the complete fin is a maximum of 75% of the radius of the propeller.

24. The device according to claim 8, wherein the at least one outer fin and/or the at least one inner fin are configured as a sweptback fins.

25. The device according to claim 24, wherein the complete fin is configured as a sweptback fin throughout.

26. A device for reducing the drive power requirement of a watercraft comprising a fore-nozzle, wherein:

at least one outer fin projects outwards from the fore-nozzle, and that a first end of the at least one outer fin is fastened to the fore-nozzle and a second end of the at least one outer fin is configured as a free end;

at least one inner fin is disposed inside the fore-nozzle, wherein a first end of the inner fin is disposed on an inner wall surface of the fore-nozzle and particularly is fastened to the fore-nozzle; and the at least one inner fin is fastened with a second end to a shaft bearing which is configured for mounting of a propeller shaft of a propeller of the watercraft.

27. The device according to claim 26, wherein the at least one outer fin and/or the at least one inner fin are disposed radially to the longitudinal axis or axis of rotation of the fore-nozzle or radially to the propeller axis of a propeller of the watercraft.

28. The device according to claim 26, wherein a plurality of outer fins are provided, wherein on the propeller upwards-turning side of the fore-nozzle more outer fins are provided than on the propeller downwards-turning side of the fore-nozzle, and/or that the outer fins are arranged in such a manner that they form an asymmetric outer fin system.

29. The device according to claim 26, wherein the at least one outer fin has a free end on which a fin end piece protruding from the outer fin is provided.

30. The device according to claim 29, wherein the fin end piece transforms into the free end of the outer fin at a radius or at an angle.

31. A device for reducing the drive power requirement of a watercraft comprising a fore-nozzle, wherein;

at least one outer fin projects outwards from the fore-nozzle, and that a first end of the at least one outer fin is fastened to the fore-nozzle and a second end of the at least one outer fin is configured as a free end;

at least one inner fin is disposed inside the fore-nozzle, wherein a first end of the inner fin is disposed on an inner wall surface of the fore-nozzle and particularly is fastened to the fore-nozzle; and the at least one outer fin is disposed in extension of the at least one inner fin and both together form a complete fin.

32. The device according to claim 31, wherein the length of the complete fin is a maximum of 90% of the radius of the propeller.

33. The device according to claim 32, wherein the length of the complete fin is a maximum of 75% of the radius of the propeller.

34. The device according to claim 31, wherein the at least one outer fin and/or the at least one inner fin are configured as a sweptback fins.

35. The device according to claim 33, wherein the complete fin is configured as a sweptback fin throughout.

* * * * *